US010557476B2

(12) United States Patent
Chen et al.

(10) Patent No.: US 10,557,476 B2
(45) Date of Patent: Feb. 11, 2020

(54) MIXED-FLOW FAN

(71) Applicant: Delta Electronics, Inc., Taoyuan (TW)

(72) Inventors: Shih-Di Chen, Taoyuan (TW); Shun-Chen Chang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 108 days.

(21) Appl. No.: 15/944,125

(22) Filed: Apr. 3, 2018

(65) Prior Publication Data

US 2019/0078580 A1 Mar. 14, 2019

(30) Foreign Application Priority Data

Sep. 14, 2017 (CN) ..... 2017 1 0829145

(51) Int. Cl.

| | |
|---|---|
| ***F04D 29/28*** | (2006.01) |
| ***F04D 17/06*** | (2006.01) |
| ***F04D 29/38*** | (2006.01) |
| *F04D 19/00* | (2006.01) |

(52) U.S. Cl.
CPC ..... *F04D 29/281* (2013.01); *F04D 17/06* (2013.01); *F04D 29/386* (2013.01); *F04D 19/002* (2013.01)

(58) Field of Classification Search
CPC ..... F04D 29/281; F04D 17/06; F04D 29/386; F04D 19/002
USPC ..... 416/177; 361/695, 678
See application file for complete search history.

(56) References Cited

U.S. PATENT DOCUMENTS

2016/0290352 A1* 10/2016 Hayamitsu ..... F04D 17/16

* cited by examiner

*Primary Examiner* — Aaron R Eastman
(74) *Attorney, Agent, or Firm* — Muncy, Geissler, Olds & Lowe, PC

(57) ABSTRACT

A mixed-flow fan includes a base including a bottom channel, an outer cover disposed on the base, a motor disposed on the base, a hub located between the outer case and the motor, and a blade connected to the hub. A main channel is formed between the outer cover and the hub, and is connected to the bottom channel. The main channel extends in the first direction, and the bottom channel extends in the second direction.

17 Claims, 5 Drawing Sheets

MIXED-FLOW FAN

CROSS-REFERENCE TO RELATED APPLICATIONS

This Application claims priority of China Patent Application No. 201710829145.6 filed on Sep. 14, 2017, the entirety of which is incorporated by reference herein.

BACKGROUND OF THE INVENTION

Field of the Invention

The present disclosure relates to a fan, and in particular to a mixed-flow fan.

Description of the Related Art

The size of today's automotive electronics systems is shrinking, and fans need to provide the highest heat dissipation in a limited installation space to meet consumers' needs. Although the strength of the air flow in a conventional axial fan is great, it often cannot be used in electronics systems due to the restrictions of the thickness and the air-flow direction of the electronic system's inlet and outlet.

The restrictions of the air-flow direction of the inlet and outlet can be overcome by using centrifugal fans (blowers). However, the strength of the air flow of centrifugal fans is low, and it is difficult to achieve the required cooling performance.

Although the fans have been generally adequate for their intended purposes, they have not been entirely satisfactory in all respects. Consequently, it is desirable to provide a solution for improving fans.

BRIEF SUMMARY OF THE INVENTION

The disclosure provides a mixed-flow fan. The strength of the air flow of the mixed-flow fan is somewhere between the strength of the air flow of the axial fan and that of the centrifugal fan. Not only does the mixed-flow fan have good heat dissipation, but it also meets flow-direction requirements.

The disclosure provides a mixed-flow fan including a base, an outer cover, a motor, a hub, and a blade. The base includes a bottom channel. The outer cover is disposed on the base. The motor is disposed on the base, and located in the outer cover. The hub is disposed on the base, and located between the outer cover and the motor. The hub is configured to rotate about a central axis, and a main channel is formed between the outer cover and the hub. The blade is connected to the hub.

The main channel is connected to the bottom channel. The main channel substantially extends in the first direction, and the bottom channel substantially extends in the second direction. A first interior angle between the first direction and the central axis is greater than a second interior angle between the second direction and the central axis.

In some embodiments, the main channel includes a main inlet and a main outlet opposite to the main inlet, and the main outlet is connected to the bottom channel, the main channel gradually narrows from the main inlet to the main outlet.

In some embodiments, the main inlet and the main outlet are ring-shaped. The first interior angle is greater than 20 degrees, and the second interior angle is less than 15 degrees.

In some embodiments, the hub includes an outer surface, the outer cover includes an inner surface facing the outer surface, and the main channel is formed between the outer surface and the inner surface. A first angle between the extension direction of the outer surface and the central axis is greater than a second angle between the extension direction of the inner surface and the central axis. The outer surface is a concave surface, and the inner surface is a convex surface.

In some embodiments, the base includes a first base body, a second base body, and a support rib. The motor is disposed on the first base body. The second base body is surrounding the first base body and separated from the first base body. The support rib is connected to the first base body and the second base body. The bottom channel is formed between the first base body and the second base body, and the support rib is located in bottom channel.

In some embodiments, the mixed-flow fan further includes a circuit board electrically connected to the motor, wherein the first base body includes a receiving groove, and the circuit board is located in the receiving groove.

In some embodiments, the thickness of the mixed-flow fan is less than 10 times the depth of the receiving groove, and the depth and the thickness are measured in a longitudinal direction parallel to the central axis.

In some embodiments, the diameter of the first base body is greater than 1.6 times the diameter of the motor. The diameter of the first base body and the diameter of the motor are measured in a transversal direction perpendicular to the central axis.

In some embodiments, the first base body includes a first side surface, and the second base body includes a second side surface facing the first side surface. The bottom channel is formed between the first side surface and the second side surface. A third angle between an extension direction of the first side surface and the central axis is less than or equal to a fourth angle between the extension direction of the second side surface and the central axis.

In some embodiments, the third angle and the fourth angle are 0 degree. In some embodiments, the second base body is a ring structure perpendicular to the central axis. The blade is a wing-shaped structure, and the blade includes various thicknesses.

In some embodiments, the hub includes an outer surface, the outer surface includes an extension section, and the extension section is located at the end of the first base body adjacent to the outer surface. In some embodiments, the extension section has a ring shape and the same diameter as the first base body. The extension section extends along the extension direction of the first side surface of the first base body.

In conclusion, depending on the design of the main channel and of the bottom channel of the mixed-flow fan of the disclosure, the strength of the air flow of the mixed-flow fan is improved.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following disclosure provides many different embodiments, or examples, for implementing different features of the present disclosure. Specific examples of components and arrangements are described below to simplify the present disclosure. For example, the formation of a first feature over or on a second feature in the following description may include embodiments in which the first and second features are formed in direct contact, and may also include embodiments in which additional features could be formed between the first and second features, such that the first and second features may not be in direct contact.

Spatially relative terms, such as upper and lower, may be used herein for ease of description to describe one element or feature's relationship to another element(s) or feature(s) as illustrated in the figures. The spatially relative terms are intended to encompass different orientations of the device in use or operation in addition to the orientation depicted in the figures.

Figure 1:
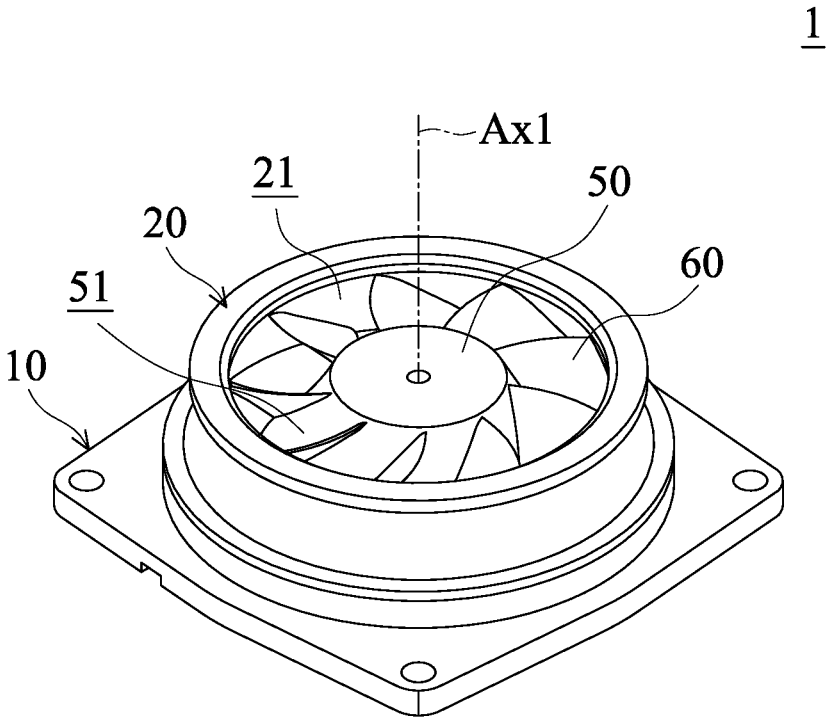
FIG. 1 is a perspective view of a mixed-flow fan in accordance with some embodiments of the present disclosure.
Figure 2:
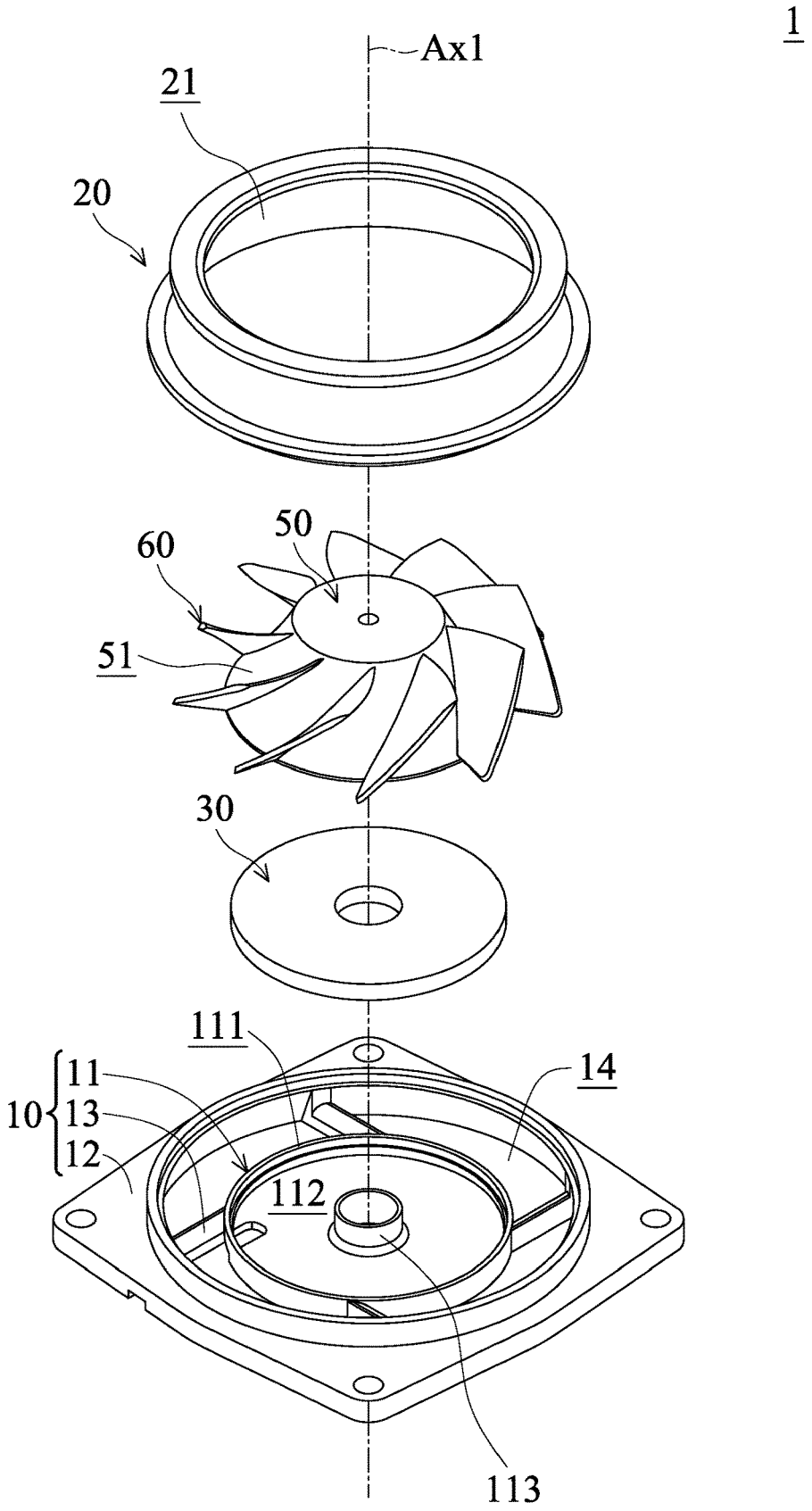
FIG. 2 is an exploded view of the mixed-flow fan in accordance with some embodiments of the present disclosure.
Figure 3:
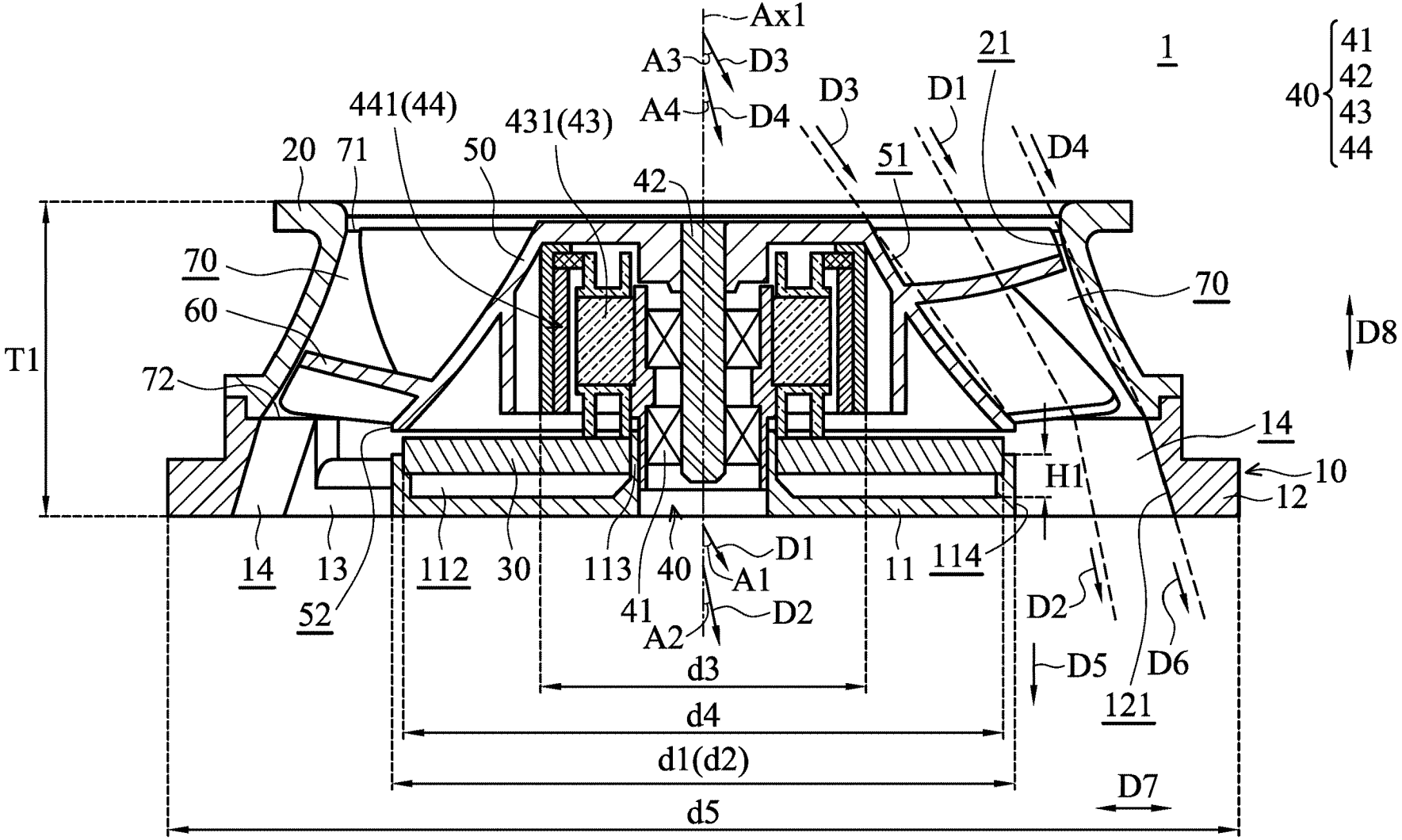
FIG. 3 is a cross-sectional view of the mixed-flow fan in accordance with some embodiments of the present disclosure.

FIG. 1 is a perspective view of a mixed-flow fan 1 in accordance with some embodiments of the present disclosure. FIG. 2 is an exploded view of the mixed-flow fan 1 in accordance with some embodiments of the present disclosure. FIG. 3 is a cross-sectional view of the mixed-flow fan 1 in accordance with some embodiments of the present disclosure. The mixed-flow fan 1 includes a base 10, an outer cover 20, a circuit board 30, a motor 40, a hub 50 and blades 60.

The outer cover 20 is disposed on the base 10. The circuit board 30 is disposed on the base 10, and located in the outer cover 20. The motor 40 is disposed on the circuit board 30, and electrically connected to the circuit board 30. The hub 50 is located between the outer cover 20 and the motor 40, and the blades 60 are connected to the hub 50. The motor 40 drives the hub 50 and the blades 60 to rotate so that an air flow is generated by the blades 60.

The base 10 is substantially a plate structure. In this embodiment, a central axis Ax1 passes through the center of the base 10, and the base 10 extends substantially perpendicular to the central axis Ax1. In some embodiments, the material of the base 10 is plastic. The base 10 includes a first base body 11, a second base body 12, and support ribs 13.

The first base body 11 is substantially a plate structure, and extends substantially perpendicular to the central axis Ax1. In this embodiment, the first base body 11 is substantially a disk structure. The first base body 11 includes a support surface 111, a receiving groove 112, and a sleeve 113. The support surface 111 is the main surface of the first base body 11, and faces the hub 50.

The receiving groove 112 is formed on the support surface 111. In this embodiment, the receiving groove 112 is ring-shaped, and the central axis Ax1 passes through the center of the receiving groove 112. The sleeve 113 is disposed on the bottom of the receiving groove 112, and extends along a central axis Ax1. In this embodiment, the sleeve 113 is a hollow columnar structure, and the central axis Ax1 passes through the center of the sleeve 113.

The second base body 12 may be a ring structure, and substantially extends perpendicular to the central axis AX1. The central axis Ax1 passes through the center of the second base body 12. The second base body 12 is around the first base body 11, and separated from the first base body 11.

The support ribs 13 are connected to the first base body 11 and the second base body 12. In this embodiment, there are four support ribs 13, but it is not limited thereto. In some embodiments, there are three, or at least five, support ribs 13.

A bottom channel 14 is formed between the first base body 11 and the second base body 12. The bottom channel 14 may be a ring shape surrounding the first base body 11. The support ribs 13 are located in the bottom channel 14. In some embodiments, the volumes of all of the support ribs 13 is less than 0.3 times the volume of the bottom channel 14.

In this embodiment, the first base body 11, the support ribs 13 and the second base body 12 are made of plastic, and are formed as a single piece.

The outer cover 20 may be a ring structure, and is disposed on the second base body 12. The central axis Ax1 passes through the center of the outer cover 20. Some elements, such as the motor 40, the hub 50, and the blades 60 are located in the outer cover 20. In some embodiments, the second base body 12 is a portion of the outer cover 20, and the second base body 12 is affixed to the support rib 13.

As shown FIGS. 2 and 3, the circuit board 30 is electrically connected to the motor 40, and located in the receiving groove 112 of the first base body 11. In this embodiment, the circuit board 30 is a ring structure, and substantially extends perpendicular to the central axis Ax1. The central axis Ax1 passes through the center of the circuit board 30.

As shown in FIG. 3, the diameter d1 of the first base body 11 is substantially equal to the greatest diameter d2 of the hub 50. Therefore, the first base body 11 does not block the air flow generated by the mixed-flow fan 1. In this embodiment, the diameter d1 of the first base body 11 is longer than 1.6 times, 1.7 times, or 1.8 times the diameter d3 of the motor 40. In some embodiments, the diameter d1 of the first base body 11 and the greatest diameter d2 of the hub 50 is about 41 mm. The diameter d3 of the motor 40 is about 22.8 mm. The diameter d1 of the first base body 11, the greatest diameter d2 of the hub 50, and the diameter d3 of the motor 40 is measured in a transversal direction D7 perpendicular to the central axis Ax1.

In some embodiments, the diameter d5 of the base 10 is about 75 mm. The diameter d5 of the base 10 is longer than 2.8 times, 3.0 times or 3.2 times the diameter d3 of the motor 40. The diameter d4 of the receiving groove 112 is about 39 mm. The diameter d4 of the receiving groove 112 is slightly shorter than the diameter d1 of the first base body 11. In other words, the diameter d4 of the receiving groove 112 is longer than 1.6 times, 1.7 times or 1.8 times the diameter d3 of the motor 40.

In some embodiments, the depth H1 of the receiving groove 112 is about 2.5 mm. The diameter d4 of the receiving groove 112 is longer than 15 times, 16 times or 17 times the depth H1 of the receiving groove 112. The thickness T1 of the mixed-flow fan 1 is about 22 mm. The thickness T1 of the mixed-flow fan 1 is less than 8 times, 9 times or 10 times the depth H1 of the receiving groove 112. The depth H1 and the thickness T1 are measured in a longitudinal direction D8 parallel to the central axis Ax1.

Therefore, due to the structures of the hub 50 and the base 10, a greater volume of the receiving groove 112 can be formed in the first base body 11. Therefore, the circuit board 30 and the more electronic elements can be disposed in the receiving groove 112.

As shown in FIG. 3, the motor 40 is located over the circuit board 30, and electrically connected to the circuit board 30. The circuit board 30 is configured to transmit a driving signal to the motor 40, and the motor 40 rotates the hub 50 according to the driving signal.

In this embodiment, the motor 40 is disposed on first base body 11, and includes a bearing 41, a shaft 42, a stator 43, and a rotor 44. The bearing 41 is affixed in the sleeve 113. The shaft 42 is rotatably disposed in the bearing 41, and extends along the central axis Ax1. The shaft 42 can be rotated about the central axis Ax1, and the end of the shaft 42 is affixed in the hub 50.

The stator 43 is disposed on the circuit board 30, and electrically connected to the circuit board 30. In this embodiment, the stator 43 is affixed to the sleeve 113. The rotor 44 is affixed in the hub 50, and around the stator 43. In this embodiment, the rotor 44 is adjacent to the stator 43, and can be rotated relative to the stator 43. In some embodiments, the stator 43 includes electromagnets 431, and the rotor 44 includes permanent magnets 441. Due to the magnetic force between the stator 43 and the rotor 44, the stator 43 drives the rotor 44 to rotate about the central axis Ax1, and thus the hub 50 and the blades 60 are rotated.

The hub 50 covers the outer side and the top of the motor 40, and can be rotated about the central axis Ax1. The hub 50 is located in the outer cover 20. A main channel 70 is formed between the outer cover 20 and the hub 50. The main channel 70 is in commutation with the bottom channel 14 of the base 10. In this embodiment, the main channel 70 is ring-shaped, and surrounds the hub 50. The main channel 70 includes a main inlet 71 and a main outlet 72 opposite to the main inlet 71. The main outlet 72 is connected to the bottom channel 14.

In this embodiment, the main inlet 71 and the main outlet 72 are ring-shaped. The central axis Ax1 passes through the centers of the main inlet 71 and the main outlet 72. The main inlet 71 and the main outlet 72 extend perpendicular to the central axis Ax1. In some embodiments, the area of the main inlet 71 is equal to or substantially equal to the main outlet 72. The main channel 70 gradually narrows from the main inlet 71 to the main outlet 72.

When the blade 60 is rotated, the blades 60 generate an air flow. The air flow enters into the mixed-flow fan 1 and the main channel 70 via the main inlet 71, and enters into the bottom channel 14 of the base via the main outlet 72. Since of the structure of the main channel 70, the air flow can smoothly pass through the main channel 70.

In this embodiment, the main channel 70 substantially extends in the first direction D1, and the bottom channel 14 substantially extends in the second direction D2. A first interior angle A1 between the first direction D1 and the central axis Ax1 is greater than a second interior angle A2 between the second direction D2 and the central axis Ax1. The first direction D1 and the second direction D2 can pass through the central axis Ax1, and the first direction D1, the second direction D2 and the central axis Ax1 are located on the same plane. Depending on the design of the main channel 70 and of the bottom channel 14, the strength of the air flow of the mixed-flow fan 1 is improved.

Figure 5:
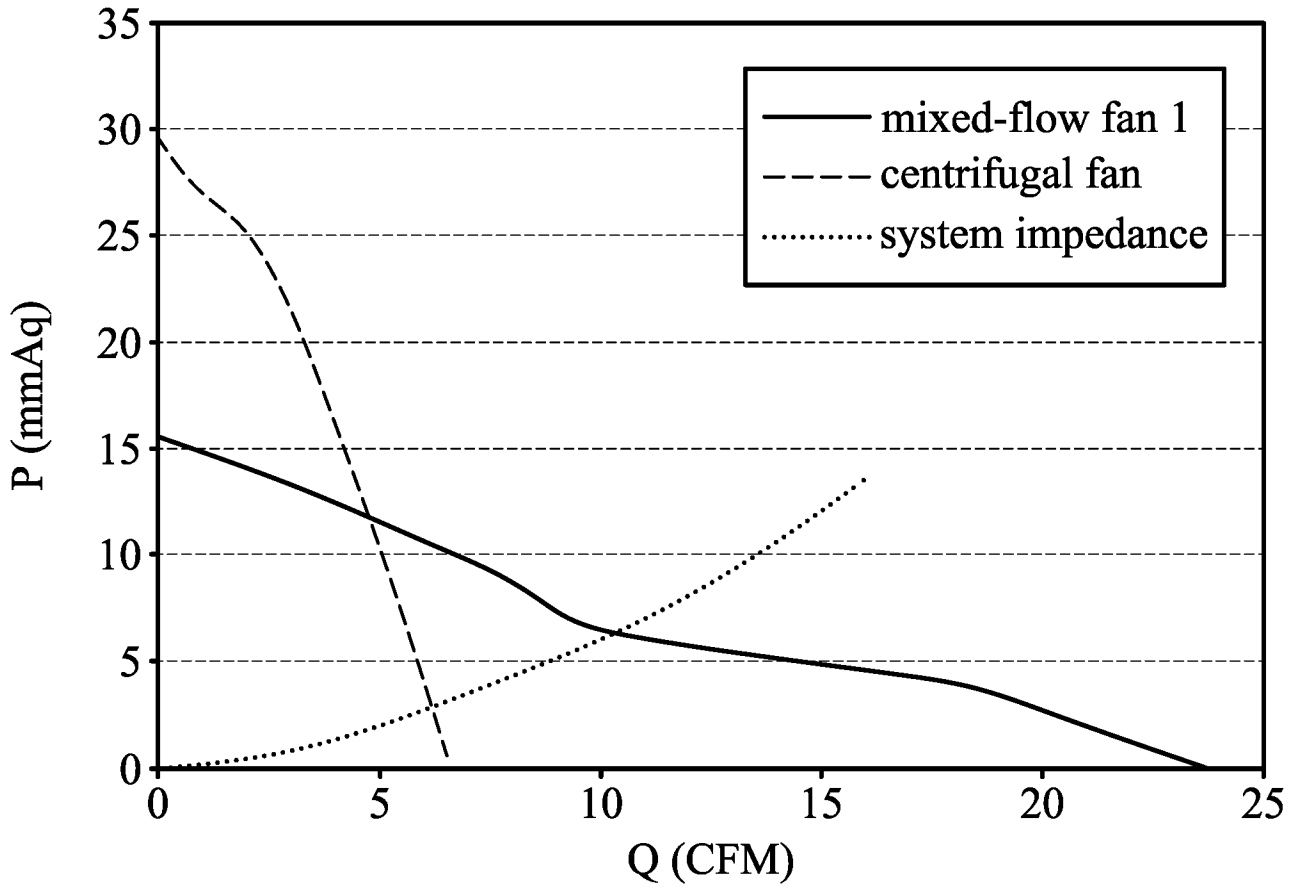
FIG. 5 is a data diagram of wind tunnel experiment of the mixed-flow fan of the disclosure and a conventional centrifugal fans.

In some embodiments, the first interior angle A1 is greater than 20 degrees, and the second interior angle A2 is less than 15 degrees. In some embodiments, the first interior angle A1 is about 30 degrees, and the second interior angle A2 is about 10 degrees. In some embodiments as shown in FIG. 5, the second interior angle A2 is about 0 degrees. In other words, the second direction D2 is parallel to the central axis Ax1.

In this embodiment, the hub 50 includes an outer surface 51, and the outer cover 20 includes an inner surface 21 facing the outer surface 51. The outer surface 51 and the inner surface 21 are ring-shaped. The main channel 70 is formed between the outer surface 51 and the inner surface 21. The outer surface 51 may be a concave surface, and the inner surface 21 may be a convex surface. The strength of the air flow of the mixed-flow fan 1 can be improved.

In some embodiments, the first direction D1 is along a straight line from a first middle point between the top of the inner surface 21 and the top of the outer surface 51 to a second middle point between the bottom of the inner surface 21 and the bottom of the outer surface 51 in a cross section of the fan 1 passing through the central axis Ax1.

As shown in FIG. 3, the slope of the inner surface 21 is greater than the slope of the outer surface 51. The outer surface 51 of the hub 50 extends or substantially extends along an extension direction D3. In some embodiments, the extension direction D3 is along a straight line from a top point to a bottom point of the outer surface 51 in the cross section of the fan 1 passing through the central axis Ax1. The inner surface 21 of the outer cover 20 extends or substantially extends along an extension direction D4. In some embodiments, the extension direction D4 is along a straight line from a top point to a bottom point of the inner surface 21 in the cross section of the fan 1 passing through the central axis Ax1.

An angle A3 between the extension direction D3 of the outer surface 51 and the central axis Ax1 is greater than an angle A4 between the extension direction D4 of the inner surface 21 and the central axis Ax1. In some embodiments, the angle A3 is greater than 40 degrees, and the angle A4 is less than 30 degrees. Moreover, in some embodiments, the angle A3 is greater than the first interior angle A1, and the angle A4 is less than the first interior angle A1. The extension direction D3 and the extension direction D4 can passes through the central axis Ax1, and the extension direction D3, the extension direction D4, and the central axis AX1 are located on the same plane.

The first base body 11 includes a first side surface 114. The second base body 12 includes a second side surface 121 facing the first side surface 114. The first side surface 114 and the second side surface 121 are ring-shaped. The bottom channel 14 is formed between the first side surface 114 and the second side surface 121.

In some embodiments, the second direction D2 is along a straight line from a first middle point between the top of the second side surface 121 and the top of the first side surface 114 to a second middle point between the bottom of the second side surface 121 and the bottom of the first side surface 114 in the cross section of the fan 1 passing through the central axis Ax1.

As shown in FIG. 3, the slope of the first side surface 114 is greater than the slope of the second side surface 121. The first side surface 114 of the first base body 11 extends or substantially extends along an extension direction D5. In some embodiments, the extension direction D5 is along a straight line from a top point to a bottom point of the first side surface 114 in the cross section of the fan 1 passing through the central axis Ax1. The second side surface 121 of the second base body 12 extends or substantially extends along an extension direction D6. In some embodiments, the extension direction D6 is along a straight line from a top point to a bottom point of the second side surface 121 in the cross section of the fan 1 passing through the central axis Ax1.

An angle between the extension direction D5 of the first side surface 114 and the central axis Ax1 is less than or equal to the angle A6 between the extension direction D6 of the second side surface 121 and the central axis Ax1. In some embodiments, the angle between the extension direction D5 and the central axis Ax1 is less than 8 degrees, and the angle A6 is less than 20 degrees.

In some embodiments, the bottom channel 14 gradually narrows from the top (close to the main outlet 72) to the bottom thereof, and thus strength of the air flow exhausted from the bottom channel 14 can be improved. In some embodiments, the angle between the extension direction D5 and the central axis Ax1 is less than 5 degrees, and the angle A6 is less than 3 degrees. In other words, the second side surface 121 is inclined relative to the first side surface 114.

In some embodiments, the angle between the extension direction D5 and the central axis Ax1 is equal to the angle A6. In other words, the first side surface 114 is parallel to the second side surface 121. In some embodiments, the angle between the extension direction D5 and the central axis Ax1 and the angle A6 are 0 degree. In other words, the first side surface 114 and the second side surface 121 extend parallel to the central axis Ax1.

Moreover, in some embodiments, the angle A6 is greater than the second interior angle A2, and the angle between the extension direction D5 and the central axis Ax1 is less than the second interior angle A2. In some embodiments, the angle A3 and the angle A4 are greater than the angle between the extension direction D5 and the central axis Ax1, and greater than the angle A6. The extension direction D5 and the extension direction D6 can pass through the central axis Ax1. Moreover, the extension direction D5, the extension direction D6, and the central axis Ax1 are located on the same plane.

In this embodiment, the outer surface 51 further includes an extension section 52. The extension section 52 is located at the end of the outer surface 51 adjacent to the first base body 11. The extension section 52 may be ring-shaped. The diameter of the extension section 52 is equal to the diameter d1 of the first base body 11. The extension section 52 and the first side surface 114 extend along the same extension direction D5. Due to the extension section 52, the air flow smoothly enters into the bottom channel 14 from the main channel 70.

Figure 4:
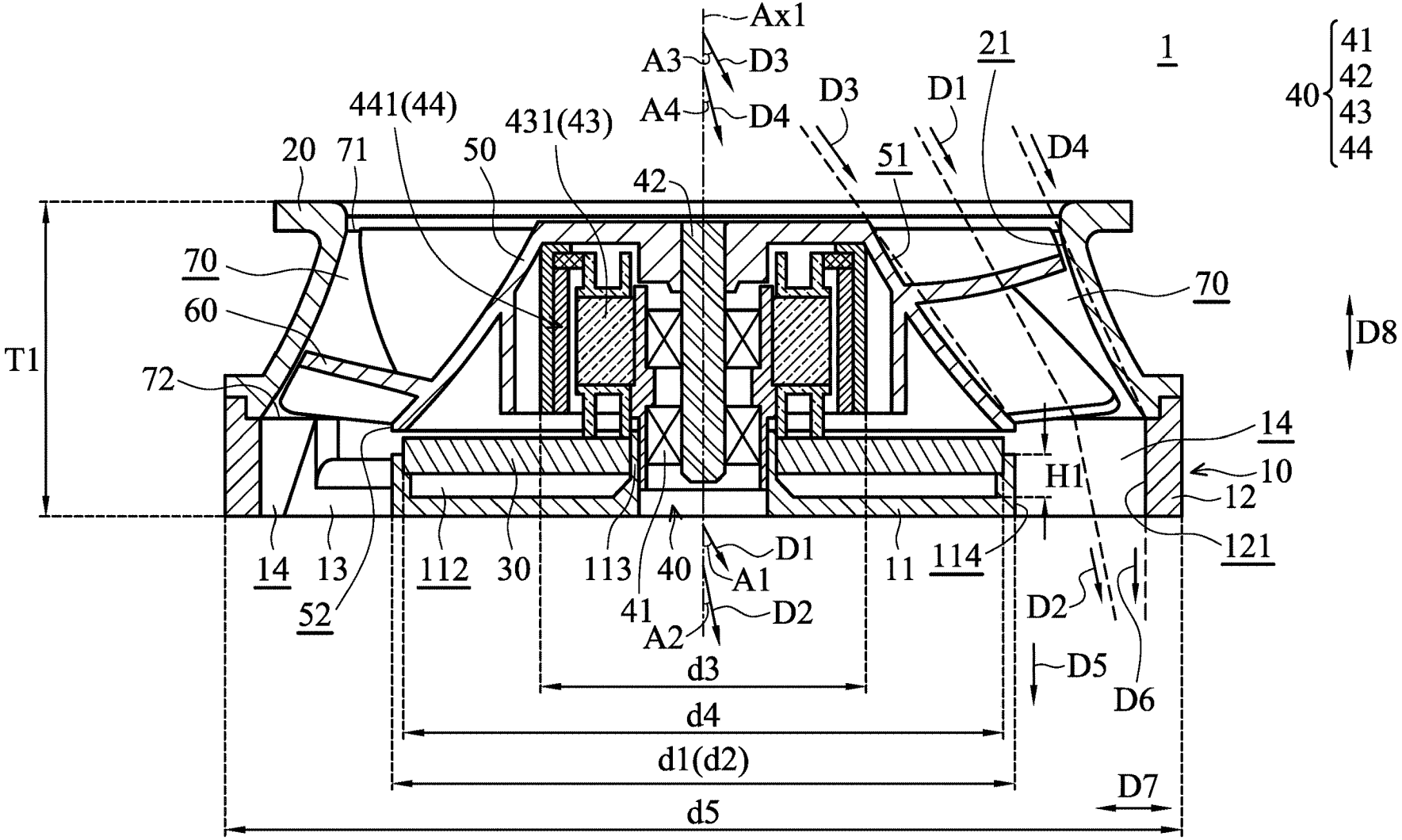
FIG. 4 is a cross-sectional view of the mixed-flow fan in accordance with some embodiments of the present disclosure.

FIG. 4 is a cross-sectional view of the mixed-flow fan in accordance with some embodiments of the present disclosure. In some embodiments, the first side surface 114 is parallel to the second side surface 121. The extension direction D5 of the first side surface 114 is parallel to the central axis Ax1. The extension direction D6 of the second side surface 121 is parallel to the central axis Ax1.

In some embodiments, the angle between the extension direction D5 of the first side surface 114 and the central axis Ax1 is 0 degree. The angle between the extension direction D6 of the second side surface 121 and the central axis Ax1 is 0 degree. Accordingly, the strength of the air flow exhausted from the bottom channel 14 can be improved.

FIG. 5 is a data diagram of wind tunnel experiment of the mixed-flow fan 1 of the disclosure and conventional centrifugal fans. As shown in FIG. 5, the mixed-flow fan 1 and the conventional centrifugal fan are substantially the same size. During the experiment in the system impedance, the strength of the air flow of the conventional centrifugal fan is about 6 CFM, whereas the strength of the air flow of the mixed-flow fan 1 of the disclosure is about 10 CFM. Therefore, depending on the design of the main channel 70 and of the bottom channel 14, the strength of the air flow of the mixed-flow fan 1 is improved. Moreover, at the same rotation speed (such as 5900 RPM), the noise of the mixed-flow fan 1 of the disclosure is about 38.7 dBA, and the noise of the conventional centrifugal fan is about 43 dBA. Therefore, the noise of the mixed-flow fan 1 of the disclosure is lower than the noise of the conventional centrifugal fan.

In conclusion, depending on the design of the main channel and of the bottom channel of the mixed-flow fan of the disclosure, the strength of the air flow of the mixed-flow fan is improved.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A mixed-flow fan, comprising:

a base comprising a bottom channel;

an outer cover disposed on the base;

a motor disposed on the base, and located in the outer cover;

a hub located between the outer cover and the motor, wherein the hub is configured to rotate about a central axis, and a main channel is formed between the outer cover and the hub; and a blade connected to the hub;

wherein the main channel is connected to the bottom channel, the main channel substantially extends in a first direction, and the bottom channel substantially extends in a second direction; and a first interior angle between the first direction and the central axis is greater than a second interior angle between the second direction and the central axis.

2. The mixed-flow fan as claimed in claim 1, wherein the main channel comprises a main inlet and a main outlet opposite to the main inlet, and the main outlet is connected to the bottom channel; and the main channel gradually narrows from the main inlet to the main outlet.

3. The mixed-flow fan as claimed in claim 2, wherein the main inlet and the main outlet are ring-shaped.

4. The mixed-flow fan as claimed in claim 1, wherein the first interior angle is greater than 20 degrees, and the second interior angle is less than 15 degrees.

5. The mixed-flow fan as claimed in claim 1, wherein the hub comprises an outer surface, and the outer cover comprises an inner surface facing the outer surface, and the main channel is formed between the outer surface and the inner surface; and wherein a first angle between an extension direction of the outer surface and the central axis is greater than a second angle between an extension direction of the inner surface and the central axis.

6. The mixed-flow fan as claimed in claim 5, wherein the outer surface is a concave surface, and the inner surface is a convex surface.

7. The mixed-flow fan as claimed in claim 1, wherein the base comprises:

a first base body, wherein the motor is disposed on the first base body;

a second base body surrounding the first base body, and separated from the first base body; and a support rib connected to the first base body and the second base body, wherein the bottom channel is formed between the first base body and the second base body, and the support rib is located in the bottom channel.

8. The mixed-flow fan as claimed in claim 7, wherein a circuit board is connected to the motor, the first base body comprises a receiving groove, and the circuit board is located in the receiving groove.

9. The mixed-flow fan as claimed in claim 8, wherein the mixed-flow fan has a thickness that is less than 10 times a depth of the receiving groove, and the depth and the thickness are measured in a longitudinal direction parallel to the central axis.

10. The mixed-flow fan as claimed in claim 7, wherein the first base body has a diameter that is greater than 1.6 times a diameter of the motor, and the diameter of the first base body and the diameter of the motor are measured in a transversal direction perpendicular to the central axis.

11. The mixed-flow fan as claimed in claim 7, wherein the first base body comprises a first side surface, the second base body comprises a second side surface facing the first side surface, and the bottom channel is formed between the first side surface and the second side surface; and wherein a third angle between an extension direction of the first side surface and the central axis is less than or equal to a fourth angle between an extension direction of the second side surface and the central axis.

12. The mixed-flow fan as claimed in claim 11, wherein the third angle and the fourth angle are 0 degree.

13. The mixed-flow fan as claimed in claim 11, wherein the second base body is a ring structure perpendicular to the central axis.

14. The mixed-flow fan as claimed in claim 7, wherein the hub comprises an outer surface, the outer surface comprises an extension section, and the extension section is located at an end of the first base body adjacent to the outer surface.

15. The mixed-flow fan as claimed in claim 14, wherein the extension section is ring-shaped and has a diameter that is the same as the diameter of the first base body.

16. The mixed-flow fan as claimed in claim 14, wherein the extension section extends along an extension direction of a first side surface of the first base body.

17. The mixed-flow fan as claimed in claim 1, wherein the blade is a wing shaped structure, and the blade has a various thickness.

* * * * *